United States Patent [19]

Gensheimer et al.

[11] Patent Number: 4,718,343

[45] Date of Patent: Jan. 12, 1988

[54] RESILIENT SHEET GRIPPER FOR A SHEET-FED ROTARY PRINTING PRESS

[75] Inventors: Valentin Gensheimer, Muhlheim/Main; Winfried Hartung, Offenbach am Main, both of Fed. Rep. of Germany

[73] Assignee: M.A.N.-Roland Druckmaschinen Aktiengesellschaft, Fed. Rep. of Germany

[21] Appl. No.: 892,761

[22] Filed: Jul. 31, 1986

[30] Foreign Application Priority Data

Aug. 19, 1985 [DE] Fed. Rep. of Germany ..... 3529596

[51] Int. Cl.[4] ..... B41F 1/30

[52] U.S. Cl. ..... 101/409; 101/415.1

[58] Field of Search ..... 101/415.1, 409; 271/277

[56] References Cited

U.S. PATENT DOCUMENTS 3,650,211 3/1972 Nentwich ..... 101/409

FOREIGN PATENT DOCUMENTS 259597 2/1927 United Kingdom ..... 101/409

897562 5/1962 United Kingdom ..... 101/415.1

*Primary Examiner*—Charles A. Pearson

*Assistant Examiner*—Huong Pham

*Attorney, Agent, or Firm*—Leydig, Voit & Mayer

[57] ABSTRACT

A resilient sheet gripper for a sheet-fed rotary printing press having a clamping member secured to a gripper shaft and a pivoting gripper finger resiliently connected to the clamping member by an adjustable compression spring is provided, including eccentric bushings mounted on the gripper shaft, the gripper finger being journaled thereon, so as to impart a positive gripper closing movement substantially perpendicular to a gripper support.

5 Claims, 2 Drawing Figures

RESILIENT SHEET GRIPPER FOR A SHEET-FED ROTARY PRINTING PRESS

FIELD OF THE INVENTION

The present invention relates generally to a sheet gripper for a sheet-fed rotary printing press and more particularly concerns such a gripper having a resilient gripper finger.

BACKGROUND OF THE INVENTION

Resilient sheet grippers are widely used in printing presses to non-positively grip a sheet of paper and hold it up against a cylinder. If the paper is pulled out of the gripper even slightly, problems arise with mackling and registration errors occur. Therefore, the gripper typically is required to have a very considerable retaining force, which usually means that the gripper springs must have a very high spring constant. Also, since any play present at the gripper tip would result in registration errors and mackling, it is desirable to minimize the bearing clearances of the gripper elements. The reduced bearing clearance, however, leads to increased friction in the gripper bearings so that some of the spring force operative for gripping is consumed in the bearing itself. The need further arises for the gripper shaft bearings to be very stable in order to reduce deformation associated with the abrupt closure of the grippers. A disadvantage of this is that very high mass forces are produced.

In short, the known gripper system require very considerable forces for their actuation and only some of such forces can be used for sheet retention. Furthermore, these substantial and abrupt forces may cause unwanted oscillations of the press.

A gripper system of this general kind is shown in DE-PS 1 174 804 wherein a one-piece gripper lever is mounted on a gripper shaft with adjustable biasing of the lever provided by a compression spring. One end of the gripper lever is connected to a spring end on a clamping element and the other end bears on the gripper support with the gripper closed and on a bearing stop with the gripper open. The compression spring is so arranged that the horizontal components of the spring force, support force and bearing force act in the same direction. The disadvantage of this type of gripper is that at very high press speeds and at elevated biasings, the gripper reacts sluggishly because of friction between the lever and the gripper shaft and because of the relatively large masses and inertia radii. Unwanted oscillations introduced into the press also cause the gripper to lose its position when the gripper tip is being centered.

Another known gripper system is disclosed in DE-OS 1 908 181 wherein the spindle of the gripper finger pivot is pivotally disposed parallel to the gripper shaft, the spindle of the gripper finger pivot being disposed substantially on the prolongation of a straight line connecting the support surface for the gripper tip to the gripper shaft axis. As is apparent from the geometry shown therein in FIG. 1, the force which the gripper tip applies to the gripper support also has a component in the direction of sheet movement. The sheet may therefore move for this reason and because of possible twisting of the gripper shaft at high biasings, even though there may be some improvement as compared with conventional grippers in which there is an arcuate motion around the gripper shaft axis.

The gripper disclosed in DD-PS 67 992 is mounted by means of a clamping member on a pivotable gripper shaft having a stationary axis. A gripper tongue makes a circular movement around such axis in a first movement phase and makes a movement substantially perpendicular to the gripper support in a second movement phase. This gripper, however, uses a non-positive parallel spring strip arrangement and a gripper tongue which cannot withstand substantial closing forces without buckling. The gripper is therefore completely unsuitable for use with very high closing forces.

Gripper systems of the type disclosed in DE-PS 2 030 040 utilize a perpendicularly closing gripper with a controlled gripper shaft. A disadvantage of this known system is that the non-positive actuation of the gripper shaft relative to the fulcrum of an actuating lever is by means of a guide on a control cam. The additional components associated with the control cam lead to increased mass forces of the system. The components also oscillate with substantial radii of inertia, leading to a reduction in press performance. Also, if dirt accumulation on the cam is fairly heavy, accurate guidance of the gripper movement phases is impossible.

The gripper system shown in DE-OS 3 130 689 uses a soft gripper support along with a gripper finger which has a flat gripper flight path and which closes perpendicularly in the final movement phase. There is a resilient abutment screw disposed in the gripper finger and operative against the sheet gripper stop. A further adjusting screw is needed to adjust the resiliently interconnected holders by which the gripper finger is associated with the gripper shaft. A disadvantage of this type of gripper is that the gripper finger must be associated with a soft gripper support and complicated adjustment must be made by means of two adjusting screws to ensure accurate operation. Furthermore, the gripping action becomes uncertain at high press speeds.

OBJECTS AND SUMMARY OF THE INVENTION

It is a primary object of the present invention to provide a gripper of the kind hereinbefore set out wherein the closing gripper finger has a second movement phase characterized by a positive movement substantially perpendicular to the gripper support.

This is accomplished, according to the present invention, by a sheet gripper having a clamping member secured to a gripper shaft and a pivoting gripper finger resiliently connected to the clamping member by a compression spring, in which the gripper finger is journaled on eccentric bushings which are mounted on the gripper shaft.

The primary advantage of the present sheet gripper is its ability to operate at high press speeds and high biasing forces without either disturbing forces or oscillations having any adverse effect in the direction of sheet movement. In addition, the present gripper is not subject to problems arising from dirt accumulation, the use of a soft gripper support, or the use of a thin gripper tip which may be prone to buckling. Moreover, sheet retention is improved by the more positive nature of the perpendicular closing step so that the gripper finger remains in its statically determined position and reacts less sluggishly.

These and other features and advantages of the invention will be more readily apparent upon reading the following description of a preferred exemplified embodiment of the invention and upon reference to the accompanying drawings wherein:

Figure 1:
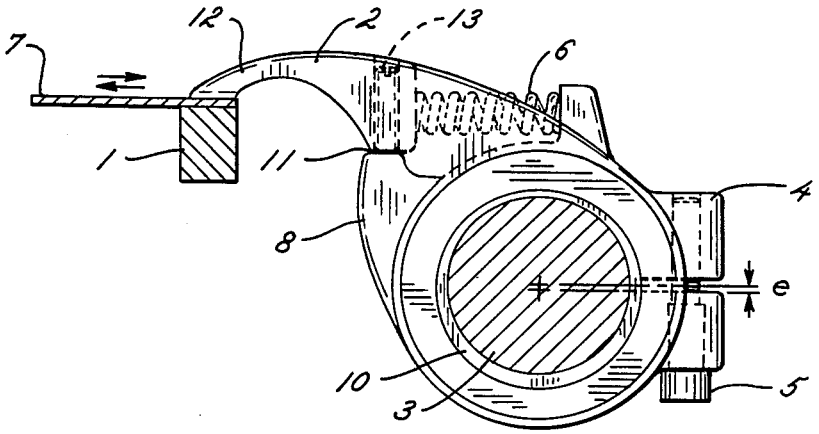
FIG. 1 is a section of a resilient sheet gripper according to the present invention.
Figure 2:
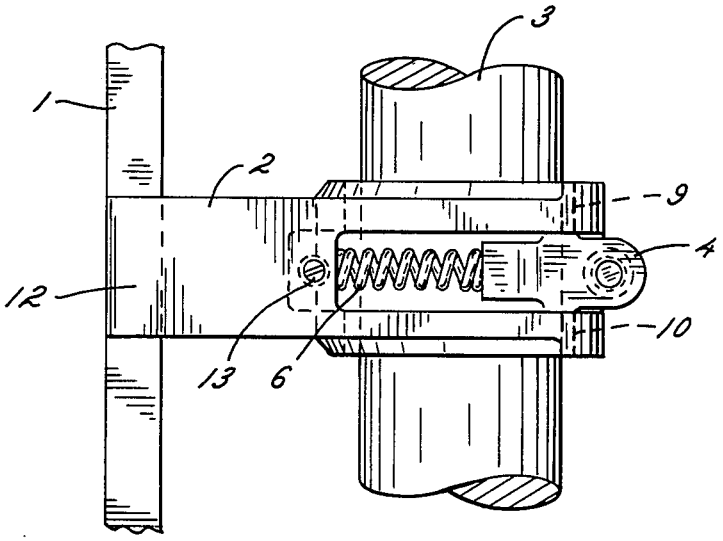
FIG. 2 is a plan view of the gripper of FIG. 1.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Turning now to the drawings, a gripper finger 2 is shown co-operating with a gripper support 1 which is secured to the wall of a groove in a cylinder of a printing press (not shown). The gripper finger 2 is mounted for rotation on eccentric bushings 9, 10 on a gripper shaft 3 so as to be resilient relative to a clamping member 4. The bearing of the gripper finger 2 is fork-shaped, with the bearing surface of each prong being journaled to one of the bushings 9, 10. The clamping member 4 is located between the prongs and is clamped by a screw 5 to the shaft 3. A spring 6 presses the finger 2 resiliently on to a sheet 7 disposed between the support 1 and a gripper tip 12. With the gripper closed, a gap 11, which is adjustable by means of a stop screw 13, is present between the finger 2 and a nosepiece 8 of the clamping member 4. With the gripper open, the finger 2 is urged by the spring 6 into engagement with the nosepiece 8.

According to the invention, since the finger 2 is mounted on the eccentric bushings 9, 10 with an eccentricity e, upon closing the gripper, the bushings 9, 10 rotate relative to the gripper finger 2 while the nosepiece 8 disengages therefrom. In this way, the sliding movement which would arise if the finger 2 were mounted centrally on the shaft 3, as a result of resilient deformation of the finger 2, support 1 and material of the sheet, is compensated for by a corresponding opposite movement (see arrows in FIG. 1).

From the foregoing, it will be appreciated that because of the positive nature of the movement, sheet transfer is positionally accurate and the closing step is performed without sliding. Furthermore, vibrations, forces, tolerances and twisting of the shaft 3 do not impair the closing forces. Also, the shaft 3 can be disposed very low below the gripper tip, so the front edge of the sheet 7 is free to move with a reduced pivot angle. In a variant of the invention, the gripper finger 2 can be mounted on eccentric facets (not shown) formed as an integral part of the gripper shaft 3.

We claim as our invention:

1. A sheet gripper assembly for use in the rotatable cylinder of a sheet-fed rotary printing press comprising a gripper support surface on said rotatable cylinder, a rotatable gripper shaft, a pivotal gripper finger mounted on said gripper shaft for movement between a closed position for engaging a sheet between said support surface and gripper finger and an open position pivoted away from said support surface, eccentric means on said shaft for supporting said gripping finger for movement relative to said gripper shaft about an axis eccentric to the axis of said gripper shaft, clamping means on said gripper shaft adapted for movement with said gripper shaft, spring means interposed between said clamping means and said gripper finger for biasing said gripper finger in a sheet engaging direction of movement, and said eccentric means and gripper shaft being rotatable relative to said gripper finger upon engagement of a sheet by said gripper finger so as to move the gripper finger about said eccentric axis for preventing relative sliding movement between said gripper finger and the engaged sheet.

2. A sheet gripper assembly according to claim 1, wherein the eccentric means are formed as part of the gripper shaft.

3. A sheet gripper assembly according to claim 1, wherein the gripper finger is fork-shaped so as to straddle the clamping means.

4. The sheet gripper assembly of claim 1 in which said eccentric means comprises a plurality of eccentric bushings mounted on said gripper shaft.

5. The sheet gripper assembly of claim 1 including means for adjusting the biasing force of said spring means.

* * * * *